US008960262B2

(12) United States Patent
Grozdanich et al.

(10) Patent No.: US 8,960,262 B2
(45) Date of Patent: Feb. 24, 2015

(54) ENCAPSULATED ARRAYS WITH BARRIER LAYER COVERED TILES

(75) Inventors: Rod Alan Grozdanich, Liberty Lake, WA (US); Edward Robert Kaczmarek, Spokane, WA (US)

(73) Assignee: Spokane Industries, Spokane, WA (US)

( * ) Notice: Subject to any disclaimer, the term of this patent is extended or adjusted under 35 U.S.C. 154(b) by 0 days.

(21) Appl. No.: 13/563,395

(22) Filed: Jul. 31, 2012

(65) Prior Publication Data

US 2013/0287988 A1 Oct. 31, 2013

Related U.S. Application Data

(60) Provisional application No. 61/639,750, filed on Apr. 27, 2012.

(51) Int. Cl.

| | |
|---|---|
| ***B22D 19/00*** | (2006.01) |
| ***B22D 19/02*** | (2006.01) |
| ***F41H 5/00*** | (2006.01) |
| ***F41H 5/04*** | (2006.01) |
| ***F41H 5/02*** | (2006.01) |

(52) U.S. Cl.
CPC *F41H 5/00* (2013.01); *B22D 19/02* (2013.01); *F41H 5/0421* (2013.01); *F41H 5/023* (2013.01)
USPC ..... 164/75; 164/98

(58) Field of Classification Search
CPC ..... B22D 19/02; F41H 5/023; F41H 5/0421
USPC ..... 164/75, 97, 98, 100
See application file for complete search history.

(56) References Cited

U.S. PATENT DOCUMENTS

| | | | | |
|---|---|---|---|---|
| 1,444,610 | A | 2/1923 | Hutchins | |
| 1,468,362 | A | 9/1923 | Hartmann | |
| 1,673,107 | A | 6/1928 | Donaldson | |
| 1,703,417 | A | 2/1929 | Donaldson | |
| 3,023,490 | A | 3/1962 | Dawson | |
| 3,552,938 | A | 1/1971 | Draca | |
| 3,616,115 | A | 10/1971 | Klimmek | |
| 3,705,558 | A * | 12/1972 | McDougal et al. | 109/84 |
| 3,874,855 | A | 4/1975 | Legrand | |
| 4,415,632 | A | 11/1983 | Luhleich et al. | |
| 4,534,266 | A | 8/1985 | Huet | |
| 4,608,318 | A | 8/1986 | Makrides et al. | |
| 4,859,541 | A | 8/1989 | Maxeiner et al. | |
| 4,926,761 | A | 5/1990 | Haesebrouck | |
| 5,066,546 | A | 11/1991 | Materkowski | |
| 5,081,774 | A | 1/1992 | Kuwano | |
| 6,112,635 | A | 9/2000 | Cohen | |
| 7,820,299 | B2 | 10/2010 | Andreussi et al. | |
| 8,499,818 | B2 * | 8/2013 | Grozdanich et al. | 164/98 |

(Continued)

OTHER PUBLICATIONS

French patent pub No. 2711782; National registration No. 91 09675; filed Jul. 30, 1991; Inventors Cameo-Ponz, et al.; 5 pages.

(Continued)

*Primary Examiner* — Kevin P Kerns
(74) *Attorney, Agent, or Firm* — Lee & Hayes, PLLC

(57) ABSTRACT

Encapsulated arrays with tiles covered with a barrier layer are disclosed. Tiles formed of silicon carbide, and wrapped with a barrier layer, are encapsulated with a base metal formed of a steel alloy. During a casting process, to fabricate the encapsulated arrays, the barrier layer prevents the steel alloy and/or the silicon carbide from compromising each other.

20 Claims, 10 Drawing Sheets

(56) References Cited

U.S. PATENT DOCUMENTS

| | | | | |
|---|---|---|---|---|
| 2006/0243127 | A1* | 11/2006 | Cohen | 89/36.02 |
| 2010/0285269 | A1* | 11/2010 | Telander | 428/113 |
| 2011/0011254 | A1* | 1/2011 | Chu et al. | 89/36.02 |
| 2012/0234163 | A1* | 9/2012 | Hunn | 89/36.02 |
| 2012/0240755 | A1 | 9/2012 | Tenold et al. | |
| 2012/0244341 | A1 | 9/2012 | Tenold et al. | |
| 2012/0244344 | A1 | 9/2012 | Tenold et al. | |
| 2013/0025440 | A1 | 1/2013 | Grozdanich et al. | |

OTHER PUBLICATIONS

"Aluminum encapsulated ceramic tiles for hybrid armor," retrieved on Jun. 27, 2011 at <<http://nextbigfuture.com/2011/01/aluminum-encapsulated-ceramic-tiles-for.html>>, Next Big Future, Jan. 15, 2011, 19 pages.

"Aluminum encapsulated ceramic tiles for hybrid armor," retrieved on Jun. 27, 2011 at <<http://beforeitsnews.com/story/359/658/Aluminum_encapsulated_ceramic_tiles_for_hybrid_armor.html>>, Before It's News, Jan. 15, 2011, 4 pages.

Coor Tek, Ceramic Armor/Military Defense and Security, retrieved on Jul. 7, 2011 at <<http://www.coorstek.com/products/ceramic-armor.asp>>, 2 pages.

Coors Tek, "Advanced metallized Ceramics for Electronic Applications," retrieved on Jul. 7, 2011 at <<http://www.coorstek.com/resources/8510-1170AdvancedMetallizedCeramics2.pdf>>, 2 pages.

Coors Tek, "Ceramic Armor," retrieved on Jul. 7, 2011 at <<http://www.coorstek.com/resources/8510-1091_Ceramic_Armor.pdf>>, 4 pages.

Coors Tek, "Vacuum Bonding," retrieved on Jul. 7, 2011 at <<http://www.coorstek.com/resources/8510-1162VacuumBonding.pdf>>, 4 pages.

Non-Final Office Action for U.S. Appl. No. 13/192,174, mailed on Aug. 29, 2012, Rod Alan Grozdanich et al., "Encapsulated Solid Ceramic Element", 7 pages.

"The HybridTech Armor(R) Technology—Ballistic Armor," retrieved on Jun. 27, 2011 at <<http://www.alsic.com/HybrdTech-Technology.html>>, CPS Tecnologies 2011, 1 page.

ZYP Coatings, Inc., retrieved on Jul. 7, 2011 at <<http://www.zypcoatings.com/>>, 1 page.

Office Action for U.S. Appl. No. 13/959,539, mailed on Sep. 27, 2013, Rod Alan Grozdanich, "Encapsulated Solid Ceramic Element", 15 pages.

Final Office Action for U.S. Appl. No. 13/959,539, mailed on Apr. 7, 2014, Rod Alan Grozdanich, "Encapsulated Solid Ceramic Element", 15 pages.

Office Action for U.S. Appl. No. 13/563,359, mailed on May 7, 2014, Rod Alan Grozdanich, "Seam Protected Encapsulated Array", 9 pages.

* cited by examiner

ENCAPSULATED ARRAYS WITH BARRIER LAYER COVERED TILES

CROSS-REFERENCE TO RELATED APPLICATION

This application claims the benefit of priority to provisional U.S. Patent Application Ser. No. 61/639,750, filed on Apr. 27, 2012 and titled "Seam Protected Encapsulated Array."

BACKGROUND

Armor for vehicles to protect them from a ballistic threat exists. Recently, armor assemblies formed of ceramic tiles encapsulated in a metal have been used.

These armor assemblies are formed of ceramic tiles and encapsulating metals (e.g., base metal) that produce a composite component having characteristics of both materials (i.e., hardness and toughness). For example, armor assemblies formed of relatively tough aluminum and relatively hard alumina tiles have been successfully fabricated.

However, the materials from which these composite components could be made has been limited due to the different properties of the ceramic and the metal. For example, certain ceramic materials may adversely react with the base metal during the manufacturing of the assemblies. For example, the adverse reaction may be chemical or physical between the materials and may compromise one or both materials, thereby detracting from the performance of the composite component. In addition, the ceramic and the metal may have different coefficients of thermal expansion, and may expand or contract at different rates. The difference between coefficients of thermal expansion may damage the metal and/or ceramic as the composite component cools during the manufacturing of the assembly, thereby detracting from the performance of the armor assembly.

Thus, there remains a need to develop new armor assemblies formed of new materials which have not heretofore been possible.

BRIEF SUMMARY

This Brief Summary is provided to introduce simplified concepts relating to techniques for manufacturing encapsulated arrays of solid ceramic elements, which are further described below in the Detailed Description. This Summary is not intended to identify essential features of the claimed subject matter, nor is it intended for use in determining the scope of the claimed subject matter.

This disclosure relates to encapsulated arrays of solid ceramic elements, cast in situ or otherwise encapsulated in a base metal, and techniques for manufacturing such assemblies. In some embodiments, such encapsulated arrays may be configured to protect, withstand, or resist ballistic impacts.

In some examples the solid ceramic elements may be encapsulated in a barrier layer to integrate or combine the solid ceramic elements with the base metal. For example, the solid ceramic elements may be formed of silicon carbide and may be covered (e.g., wrapped, coated, enclosed, etc.) with the barrier layer to integrate with an encapsulating iron alloy. In this example, the barrier layer may prevent the base metal from reacting with the ceramic material units during a casting process and/or provide crush/compression protection for the ceramic material during a cooling process.

In some examples the barrier layer may include a first barrier layer (e.g., a refractory layer) and a second barrier layer (e.g., a compressible layer) to integrate or combine the solid ceramic elements formed of silicon carbide with the iron alloy.

In examples where two or more ceramic elements are arranged in an adjacent, subjacent, and/or overlapping manner, a seam protector made of a harder material than the base metal may be used. The seam protector may be arranged in-line with the seams between ceramic elements of the encapsulated array. For example, the solid ceramic elements arranged adjacent to each other in the encapsulated array may have an interface between the adjacent solid ceramic elements. This interface defines a seam which may be vulnerable to penetration by a ballistic projectile. The seam protector, formed of the harder material, may be fixed to the surface and arranged in-line with the vulnerable seam to protect the vulnerable seam from penetration by a ballistic projectile.

In examples where stiffening is desired, a stiffener may be fixed to a same or different surface of the encapsulated array as the surface having the seam protector. Similar to the seam protector, the stiffener may be fixed to the surface of the encapsulated array during or after the casting process.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
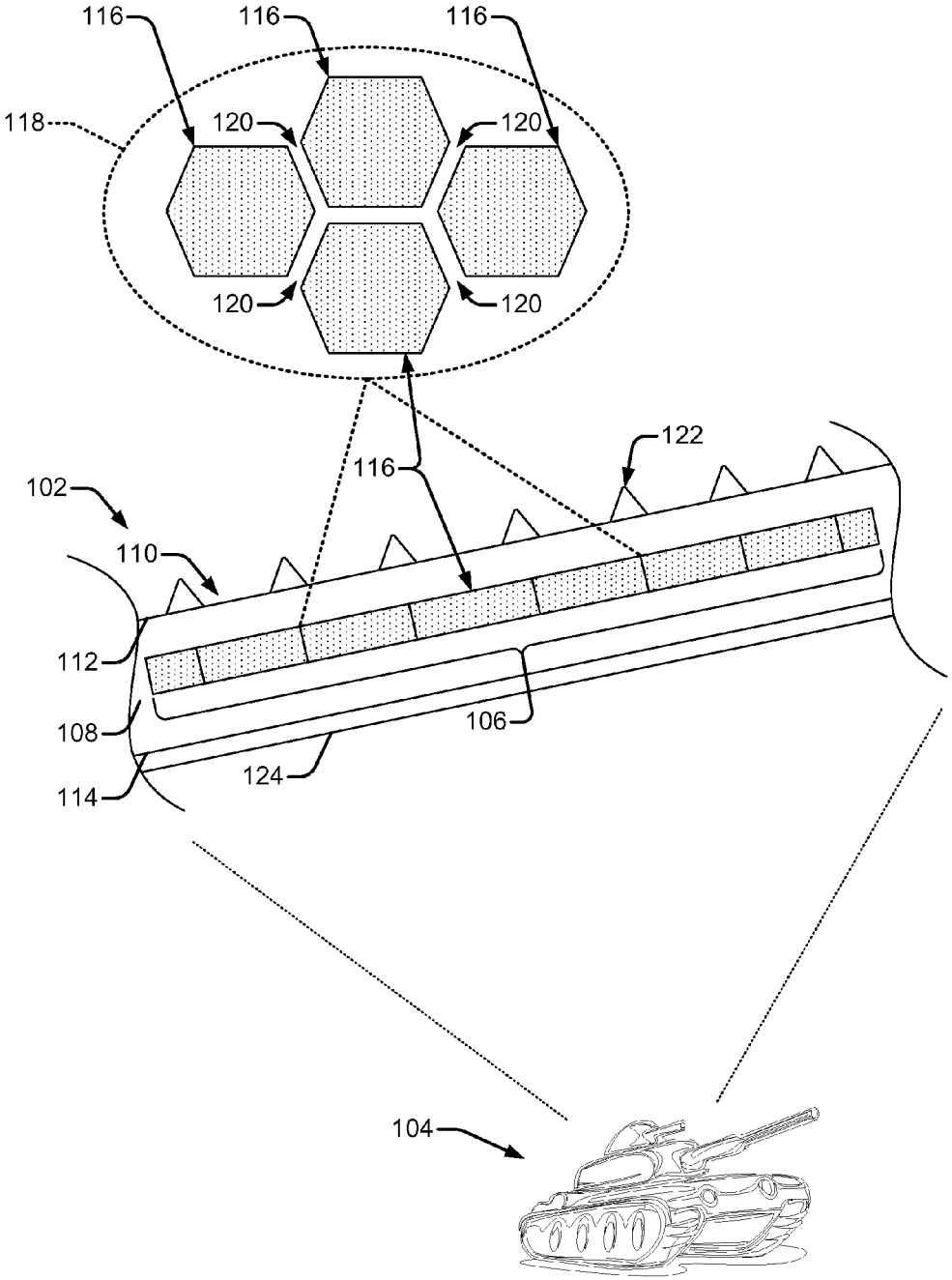
FIG. 1 illustrates a vehicle having an example ballistic armor comprising a seam protected encapsulated array of solid ceramic elements.

As noted above, armor assemblies still have weaknesses that are vulnerable to penetration by a ballistic projectile. Further, integrating silicon carbide tiles in an encapsulating iron alloy is often difficult because of the varying or dissimilar properties of the materials from which the armor assemblies are made. This application describes armor assemblies comprising solid ceramic tile arrays formed of silicon carbide encapsulated in an iron alloy that, together, exhibit improved resistance to impact compared with other armor assemblies. This application also describes various techniques for manufacturing such encapsulated solid ceramic tile arrays. By way of example and not limitation, the encapsulated solid ceramic tile arrays herein may be used in the fields of military applications, security applications, or any other applications that may be exposed to impacts by ballistic projectiles or other high speed objects.

In general, encapsulated solid ceramic tile arrays as described in this application include relatively hard silicon carbide tiles that are harder than alumina tiles, and encapsulated by a relatively tough iron alloy (e.g., steel alloys such as FeMnAl alloys). This application describes techniques for manufacturing such encapsulated solid ceramic tile arrays using investment casting techniques. However, other casting techniques may also be used.

As described in U.S. patent application Ser. No. 13/192,174 (now U.S. Pat. No. 8,499,818), filed on Jul. 27, 2011, entitled "Encapsulated Solid Ceramic Element," which is incorporated herein by reference, casting techniques may include methods or steps of casting a steel alloy at desired temperatures and/or methods or steps of preheating a ceramic unit to desired temperatures. For example, a ceramic element may be wrapped in a steel film and may be preheated to at least about 1500 degrees F. to at most about 2500 degrees F., and the molten steel may be poured at least about 2100 degrees F. to at most about 3100 degrees F. Further, a ceramic element may be wrapped in an aluminum film and preheated to at least about 900 degrees F. to at most about 1900 degrees F., and the molten steel may be poured at least about 2000 degrees F. to at most about 3000 degrees F.

In some embodiments, the ceramic elements may be coated with one or more barrier layers or coatings to prevent interaction or reaction between the ceramic elements and the molten metal during the casting process. In one example, an interaction or reaction between the ceramic elements and the molten metal during the casting process may be characterized as a reaction between a molten metal comprising a steel alloy and the ceramic elements formed of silicon carbide. For example, during a casting process, a molten steel alloy may have a temperature of about 2732 degrees F. and may undesirably react with the ceramic element formed of silicon carbide. During the reaction, the steel alloy may react undesirably with the silicon carbide to form graphite. Further, multiple reaction layers at an interface between the solidified steel alloy and the silicon carbide may be produced during the reaction. In addition to the above, the steel alloy may penetrate the silicon carbide to some depth. All of these results compromise the integrity of the composite component.

As such, casting a ceramic element formed of silicon carbide encapsulated with a steel alloy without utilizing one or more barrier layers or coatings during the casting process results in a compromised assembly. For example, casting a steel alloy onto a ceramic element formed of silicon carbide without utilizing one or more barrier layers or coatings may result in a compromised ceramic element (e.g., partially dissolved ceramic element) encapsulated by a compromised steel alloy casing (e.g., cracked casing). To prevent the interaction or reaction between dissimilar materials during a casting process, a barrier layer and/or coating may be applied to the ceramic material prior to casting the metal around the ceramic. The barrier layer and/or coating may provide an interface or zone that prevents the interaction or reaction between the ceramic elements and molten metal during a casting process.

In an example, where the barrier layer or coating may prevent the interaction or reaction between the ceramic elements and the molten metal, the barrier layer(s) or coating(s) may comprise, for example, a refractory layer encapsulating each solid ceramic element in the array of solid ceramic elements. For example, the refractory layer may comprise a metal film. The metal film may be, for example, a foil layer, a powder coat, an electroplating layer, a painted layer, etc. encapsulating the solid ceramic elements. In one specific example, a ceramic element may be wrapped in an aluminum foil layer.

In some embodiments, the barrier layer and/or coating may additionally or alternatively provide crush or compression protection between the ceramic elements and the base metal to allow for shrinkage of the encapsulating metal during and after solidification. For example, the ceramic elements and the base metal may have different coefficients of thermal expansion and the base metal may shrink disproportionately more relative to the ceramic elements. Specifically, the base metal may have a higher shrinkage percentage than a ceramic element. Stated otherwise, the ceramic element may shrink less than the base metal as the ceramic element and the base metal cool after solidification of the base metal. Because the ceramic element may shrink less than the base metal, the base metal may shrink down onto the ceramic element, resulting in the base metal being in tension and the ceramic elements being in compression. The resulting forces may be sufficient to cause damage to either or both of the ceramic elements and the base metal. Cracking in either or both of the ceramic elements and the base metal may compromise or detract from the performance of the encapsulated solid ceramic tile arrays. The barrier layer and/or coating may provide an interface or zone that dampens the compression force during shrinkage of the solidified base metal, preventing cracking and/or voids from in either or both of the ceramic elements and base metal. That is, the barrier layer may be crushable or compressible to allow the base metal to shrink around the ceramic elements without damaging the ceramic material or the base metal.

In an example, where the barrier layer or coating may provide crush or compression protection between the ceramic elements and the base metal during shrinkage after solidification, the barrier layer(s) or coating(s) may comprise, for example, a compressible, porous coating comprising alumina fiber, ceramic, copper, nickel, or the like. For example, porous coatings formed of fibers, granules, powders, etc. may include interstitial spaces that when crushed or compressed, reduce in size or volume.

In some embodiments, the barrier layer or coating may comprise more than one layer or coating to prevent interaction or reaction between the ceramic elements and the molten metal during the casting process, and to provide a crush or a compression protection between the ceramic elements and the molten metal during the casting process. For example, the barrier layer or coating may include a first layer (e.g., refractory layer) and a second layer (e.g., compressible layer).

In an example where the barrier layer or coating may prevent interaction or reaction and provide a crush or a compression protection between the ceramic elements and the molten metal during the casting process, the first layer may encapsulate the second layer.

Further, a wall thickness of the barrier layer or coating may vary depending on the specific application and/or on a density of the barrier layer. For example, the wall thickness may be dependent on thermal expansion coefficients of a base metal and a ceramic material to be accommodated. In addition, the wall thickness may depend on a desired seam size (e.g., gap between each ceramic element) of an encapsulated solid ceramic tile array. In a specific example, the base metal may be formed of an iron alloy (e.g., FeMnAl) that encapsulates ceramic elements formed of silicon carbide, the ceramic elements may be wrapped in a barrier layer having a wall thickness of about 0.06 inches (0.15 centimeters). In other examples between about 0.04 inches (0.1 centimeters) and about 0.08 inches (0.2 centimeters).

In some embodiments, the ceramic materials comprise, solid, substantially flat elements (e.g., sheets, plates, blocks, or tiles), of silicon carbide, that are arranged in configurations of three or more sides (e.g., triangle, square, pentagon, hexagon, octagon, or any other polygonal shape). For example, the ceramic material may comprise one or more ceramic elements, each having a front side and back side, which are parallel to each other, and sidewalls, which are substantially perpendicular to the front and back sides. The width of the ceramic elements may vary depending on the specific application. In some examples, the ceramic elements may have a diagonal width of about 4 inches (10 centimeters). Similarly, the thickness of the ceramic elements may vary depending on the specific application. In some examples, the ceramic elements may have a thickness of between about ½ inches (1.3 centimeters) and about 2 inches (5 centimeters); however, in other examples, the thickness of the ceramic elements may be less than ½ inches (1.3 centimeters) or greater than 2 inches (5 centimeters). In a specific example, the ceramic elements may have a thickness of between about ¾ inches (2 centimeters) and about 1⅜ inches (3.5 centimeters). In some embodiments, the intersection of the front and/or back sides with the sidewalls may be rounded or chamfered.

Also, in some embodiments, the encapsulating metal layer on the front and back sides of the ceramic elements may be at least about ⅛ inches (0.3 centimeters) thick. However, the metal layers on the front and back need not be the same. In one example, the encapsulating metal later on one side of the ceramic elements may be about ¼ inches-½ inches (0.6 centimeters-1.3 centimeters) thick, while the encapsulating metal layer on the other side of the ceramic elements may be at least about ½ inches (1.3 centimeters) thick. In a more specific example, the encapsulating metal layer on one side of the ceramic elements may be about ¼ inches (0.6 centimeters) thick, while the encapsulating metal layer on the other side of the ceramic elements may be about 1⅜ inches (3.5 centimeters) thick. However, in other embodiments, any other thickness of base metal may be used. Furthermore, the thickness on the front and/or back may be non-uniform. For example, the front and/or back surfaces may have one or more protruding or indenting features, such as ribs, ridges, grooves, channels, fins, quills, pyramids, mesh, nubs, dimples, or the like. The features may protrude or indent perpendicular to the respective surface or at an oblique angle relative to the respective surface.

Also, in some embodiments, the encapsulating metal layer may include an additive. For example, a grit may be added to the encapsulating base metal during the casting process. The grit may be added substantially throughout the encapsulating base metal or the grit may be added to the encapsulating base metal at specific areas of the encapsulated solid ceramic tile arrays. For example, the grit may be added to a front of the encapsulated solid ceramic tile arrays, a back of the encapsulated solid ceramic tile arrays, along seams of the encapsulated solid ceramic tile arrays, or any other area or combination of areas of the encapsulated solid ceramic tile arrays. The grit may be formed of a ceramic, a metal, a mixture of ceramic and metal, or the like.

Also, while the ceramic element embodiments described herein employ silicon carbide, other ceramic materials may also be used for the ceramic elements such as, for example, alumina, zirconia, tungsten carbide, titanium carbide, boron carbide, zirconia-toughened alumina (ZTA), partially stabilized zirconia (PSZ) ceramic, silicon oxides, aluminum oxides with carbides, titanium oxide, brown fused alumina, combinations of any of these, or the like.

The encapsulating metal and/or a stiffener may comprise a relatively tough steel alloy, such as FeMnAl, stainless steel, 4140 AISI steel, or 8630 AISI steel. As used herein, the term "steel" includes alloys of iron and carbon, which may or may not include other constituents such as, for example, manganese, aluminum, chromium, nickel, molybdenum, copper, tungsten, cobalt, and/or silicon. As used herein, the term FeMnAl includes any iron based alloy including at least about 3% manganese by weight, and at least about 1% aluminum by weight. In another specific example, high-chrome iron (or white iron) may be used as a base metal for an encapsulating metal. In other examples, still other base metals (e.g., titanium, etc.) may be used to encapsulate ceramic elements according to this disclosure.

Ranges of what is considered "relatively hard" and "relatively tough" may vary depending on the application, but in one example "relatively hard" materials are those having a Vickers Hardness of at least about HV=1300 (13 GPa) or a Knoop hardness of at least about HK=800 (2.7 GPa), and "relatively tough" materials are those having a an impact toughness of at least about 10 ft-lbs at −40 degrees F. and/or a tensile strength of at least about 80,000 psi in the "as cast," non-heat treated state. In some examples, relatively tough materials may have an impact toughness of at least about 20 ft-lbs at −40 degrees F. and/or a tensile strength of at least about 100,000 psi in the "as cast," non-heat treated state. To be clear, however, this disclosure is not limited to using materials having the foregoing ranges of hardness or toughness.

These and other aspects of the encapsulated arrays of solid ceramic elements will be described in greater detail below with reference to several illustrative embodiments.

Example Seam Protected Encapsulated Arrays

This section describes an exemplary encapsulated array of solid ceramic elements comprising an encapsulated array of solid ceramic elements including a barrier layer covering solid ceramic elements.

In some implementations, the encapsulated array of solid ceramic elements may include a seam protector and/or a stiffener. These and numerous other seam protected encapsulated arrays of solid ceramic elements can be formed according to the techniques described in this section.

FIG. 1 is a side view diagram of a seam protected encapsulated array 102 used, for example, as ballistic armor on a vehicle 104. Metal/ceramic composite materials are well suited to ballistic-resistant applications due to the characteristics of the materials. For example, metals typically provide a relatively high strength-to-weight ratio and a high toughness, while ceramics have a relatively high hardness. Additionally, in part because the crack propagation speed of ceramics is below the speed of a ballistic projectile, ceramic materials provide extremely strong defense to ballistic impacts.

As shown in FIG. 1, the seam protected encapsulated array 102 comprises an array of ceramic elements 106 encapsulated in a metal alloy 108. The cast assembly includes the metal alloy 108, and the array of ceramic elements 106 defines an encapsulated array 110. As shown in the side view, the encapsulated array 110 may include a first surface 112 opposite a second surface 114. In this embodiment, the first surface 112 of the encapsulated array 110 is substantially parallel to the second surface 114 of the encapsulated array 110. However, in other embodiments, the first and second surfaces 112, 114 of the encapsulated array 110 need not be parallel and may be sloped or curved relative to one another.

The seam protected encapsulated array 102 may be installed on, in, or around, the vehicle 104 so that the first surface 112 is facing outward from the vehicle 104. Further, the seam protected encapsulated array 102 may be installed on the vehicle 104 based on a ballistic impact threat to different segments of the vehicle 104. For example, the sides of the vehicle 104 may constitute the highest threat from ballistic impact, the top of the vehicle 104 may constitute the lowest threat from ballistic impact, and the bottom may constitute a medium threat from ballistic impact. A seam protected encapsulated array 102 may be installed on the vehicle 104 to protect the vehicle 104 from ballistic threats based on various factors (e.g., weight, performance, cost). For example, a seam protected encapsulated array 102 may be installed on the sides of the vehicle 104 to protect the vehicle 104 from the highest threat from ballistic impact.

The array of ceramic elements 106 may include two or more ceramic elements 116. The geometry of a ceramic element 116 in the array of ceramic elements 106 may vary widely depending on the application, requirements, geometry, or other characteristics of the seam protected encapsulated array 102. Each of the ceramic elements 116 may be arranged to minimize space between ceramic elements 116 or to achieve overlap between ceramic elements. In one example, top view diagram 118 illustrates each ceramic element 116 comprising a hexagonal perimeter. However, in other examples, the ceramic elements 116 may have a perimeter with any number of three or more sides. A thickness of the ceramic elements 116 may vary depending on an intended application. For example, for some ballistic applications, the ceramic elements 116 may be between about 0.5 inches (1.3 centimeters) and about 2 inches (5 centimeters). However, in other embodiments, the ceramic elements 116 may be thinner or thicker.

As shown in the side view, the array of ceramic elements 106 includes two or more ceramic elements 116 arranged in an adjacent manner where each ceramic element is encapsulated by the metal alloy 108. In this specific example of the encapsulated array 110, the ceramic elements 116 are arranged in the same plane. However the ceramic elements 116 may also be arranged in an overlapping or subjacent manner. As shown in the top view 118, the ceramic elements 116, in this example, may be arranged in pentagonal configuration. In this specific example, the ceramic elements 116 are arranged to minimize seams 120 between adjacent ceramic elements 116.

The seams 120 may be defined by an interface between a ceramic element 116 arranged adjacent to another ceramic element 116 in the encapsulated array 110, where the seams 120 may be a vulnerable area of the encapsulated array 110. For example, because the seams 120 may be void of ceramic material (e.g., void of any ceramic element 116), and consist primarily of the metal alloy 108, the seams 120 may be areas of the encapsulated array 110 that are weaker than areas of the encapsulated array 110 having both the ceramic element 116 and the metal alloy 108 combined in layers.

As shown in the side view of FIG. 1, the encapsulated array 110 may include a seam protector 122. The seam protector 122 may be a lattice structure fixed to the first surface 112 of the encapsulated array 110 and arranged in-line with the vulnerable seams 120. The geometry of the lattice structure may comprise a hexagonal prismatic honeycomb. For example, the lattice structure may comprise a plurality of hexagonal rings arranged adjacent to each other and each hexagonal ring may have a peak opposite a base configured to align with a seam. Because the seam protector 122 is fixed to the first surface 112 of the encapsulated array 110, the seam protector 122 is exposed to projectiles first before the seams 120. Further, because the seam protector 122 may be formed of a hard material (e.g., a white iron or a ceramic), when the projectile first encounters the seam protector 122, the projectile is compromised, redirected, deflected, and/or broken apart upon impact.

FIG. 1 illustrates that the seam protected encapsulated array 102 may include a stiffener 124. The stiffener 124 may be fixed to the second surface 114 of the encapsulated array 110, and may provide the encapsulated array 110 with an increased stiffness. For example, the stiffener 124 may be a structural lattice member in the form of a truss (e.g., a flat truss), and increase the encapsulated array's 110 resistance to bending relative to the encapsulated array 110 without the stiffener 124. The increased stiffness provided by the stiffener 124 keeps the encapsulated solid ceramic elements 116 in compression with the metal alloy 108 during use. For example, the stiffener 124 may substantially reduce an amount the encapsulated array 110 is displaced (e.g., bent, flexed, deformed, etc.) while the seam protected encapsulated array 102 is in use on a vehicle 104.

Figure 2:
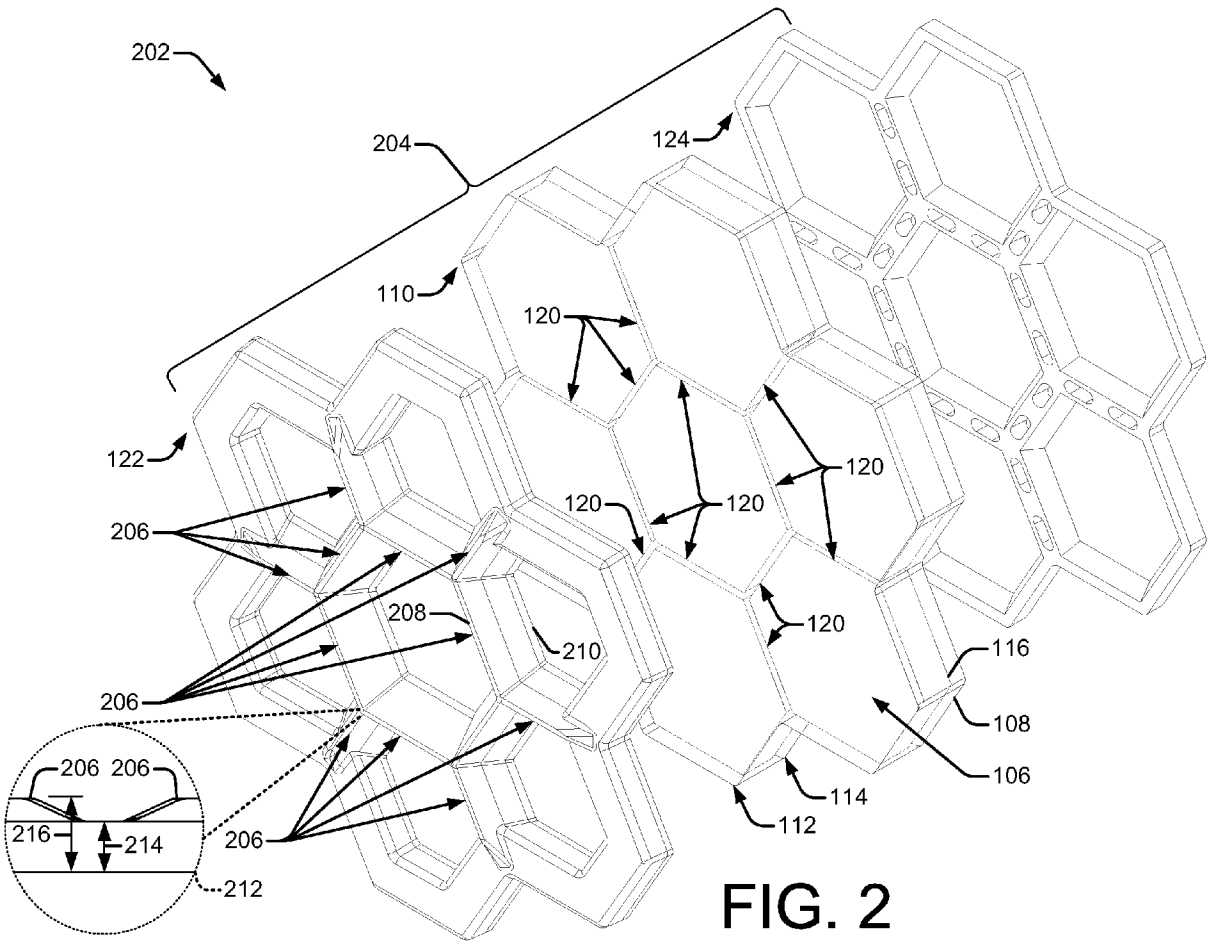
FIG. 2 illustrates an exploded assembly of a seam protected encapsulated array of solid ceramic elements.

FIG. 2 illustrates an exploded assembly view 202 of a seam protected encapsulated array of solid ceramic elements 204. The seam protected encapsulated array 204 may include the seam protector 122 and/or the stiffener 124 fixed to the encapsulated array 110.

The encapsulated array 110 may include the array of ceramic elements 106. The array of ceramic elements 106 may include the ceramic elements 116 arranged in an adjacent manner and encapsulated in the metal alloy 108. The encapsulated array 110 may include the seams 120, which may be defined by the interfaces between adjacent ceramic elements 116.

The seam protector 122 may include one or more members 206 arranged in a lattice structure. The lattice structure of the seam protector 122 may mirror the geometric pattern of the array of ceramic elements 106. For example, the geometric pattern of the seam protector 122 may outline the geometric pattern of the array of ceramic elements 106. The lattice structure of the seam protector 122 may have the bulk of the material of the seam protector 122 arranged around the edges of the ceramic elements 116 and apertures arranged above each ceramic element 116.

Each member 206 may include a peak 208 opposite a base 210. Each base 210 may be fixed to the first surface 112 of the encapsulated array 110 and each peak 208 may be arranged in-line with a respective vulnerable seam 120.

While FIG. 2 illustrates each member 206 being connected or joined to each other, each member 206 may be an individual unit. For example, each member 206 may be a single unit including a peak 208 and a base 210. The members 206 may be formed as a single unit to limit damage to only the impacted area and prevent crack propagation or shattering of the whole seam protector. In examples, where each member 206 is a single unit, each member 206 may be fixed to the first surface 112 of the encapsulated array 110, respectively. For example, the base 210 of each member 206 may be fixed to the first surface 112 of the encapsulated array 110, respectively.

Further, as illustrated in side view 212, each member 206 may be segmented via a failure zone 214. For example, the failure zone 214 may be a notch, a thin walled section, a groove, a perforation, or the like, disposed between each member 206. Each of the failure zones 214 may be weaker than a wall thickness 216 of each of the members 206. For example, each failure zone 214 may be configured to break upon a predetermined impact of a ballistic projectile on a member 206. The predetermined impact on the member 206 may break a failure zone 214 between the member 206 receiving the impact and an adjacent member 206 not receiving an impact. Because each failure zone 214 may break upon a predetermined impact, the failure zones 214 prevent propagation of breakage from one member 206 to another member 206 in the seam protector 122.

The stiffener 124 may comprise a similar or different lattice structure as the seam protector 122. For example, the stiffener 124 may also outline the geometric pattern of the array of ceramic elements 106, have the bulk of the material of the stiffener 124 arranged around the edges of the ceramic elements 116, and have apertures arranged above each ceramic element 116. The stiffener may have a similar or different geometric cross section as the seam protector. For example, the stiffener may comprise a plurality of hexagonal rings arranged adjacent to each other. Each of the hexagonal rings of the stiffener may include a planar surface opposite another planar surface. The stiffener 124 may be fixed to the second surface 114 of the encapsulated array 110 and arranged in-line with the vulnerable seams 120.

Figure 3:
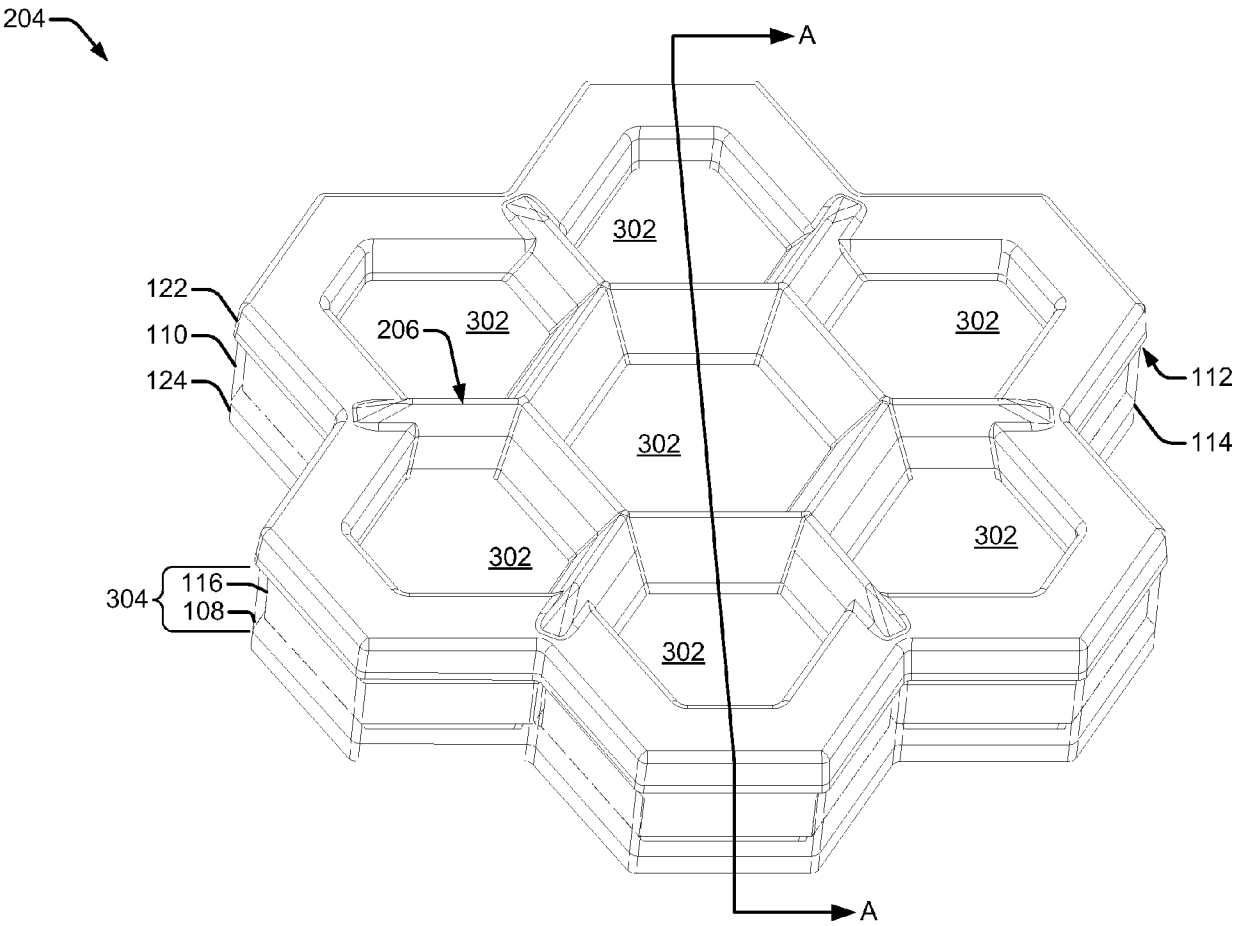
FIG. 3 illustrates a front of the seam protected encapsulated array of solid ceramic elements illustrated in FIG. 2.

FIG. 3 illustrates the front of the seam protected encapsulated array of solid ceramic elements 204 illustrated in FIG. 2. FIG. 3 illustrates that the seam protector 122 may be fixed to the first surface 112 of the encapsulated array 110 and arranged in-line with the vulnerable seams 120. For example, each member 206 of the seam protector 122 may fixed to the first surface 112 and arranged in-line with a vulnerable seam 120. With the seam protector 122 arranged in-line with the vulnerable seams 120, only areas 302 are exposed to a ballistic threat. Each of the areas 302 may comprise a composite layer 304 including at least a ceramic element 116 and the metal alloy 108, and thus the areas 302 are configured to protect, withstand, or resist ballistic impacts.

Figure 5:
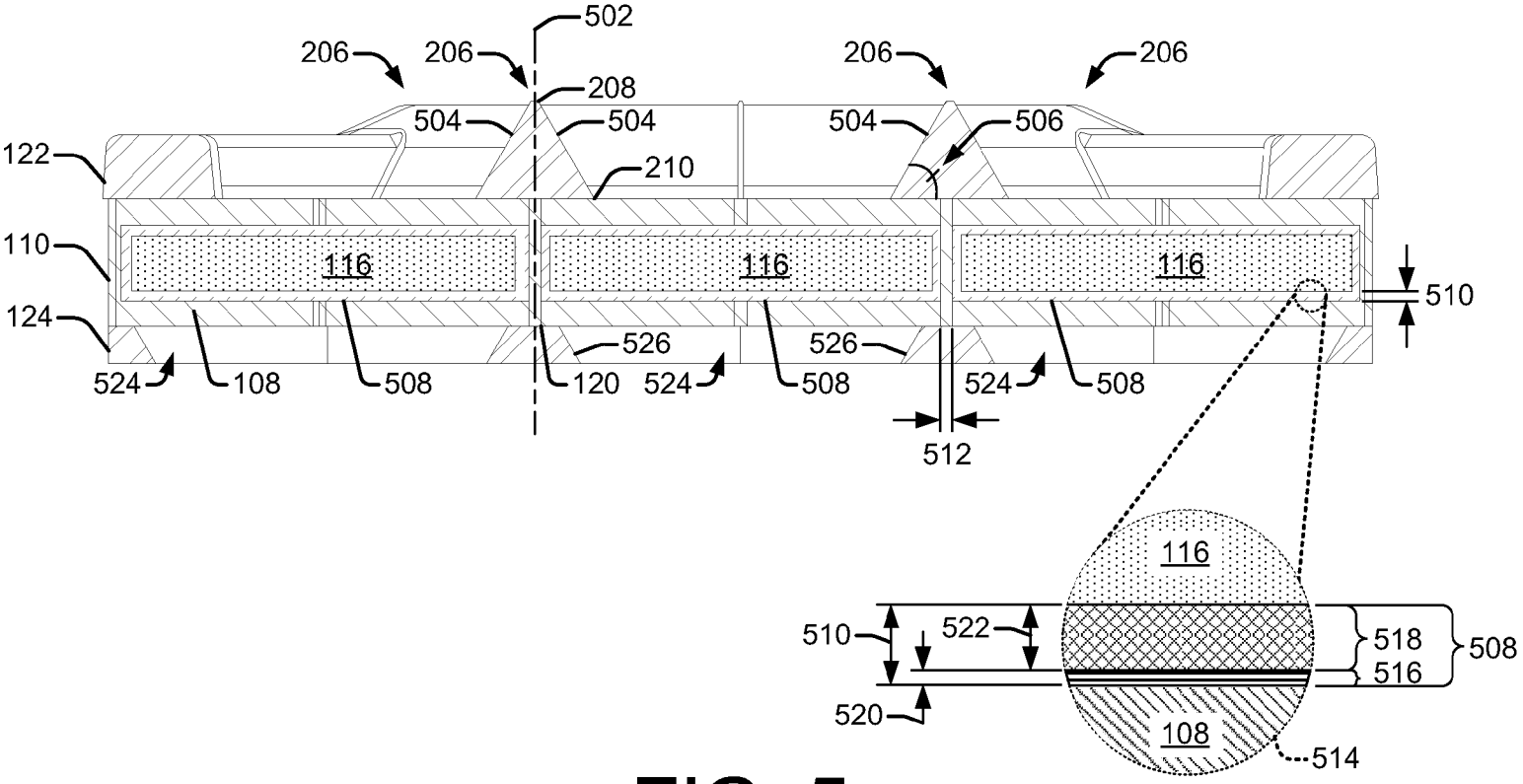
FIG. 5 illustrates a section view of the seam protected encapsulated array of solid ceramic elements illustrated in FIG. 3.

FIG. 3 also illustrates a section line A-A. The section line A-A is approximate to a center of the seam protected encapsulated array of solid ceramic elements 204. FIG. 5, illustrates a section view of the seam protected encapsulated array of solid ceramic elements taken along the section line A-A, and is discussed below in more detail.

Figure 4:
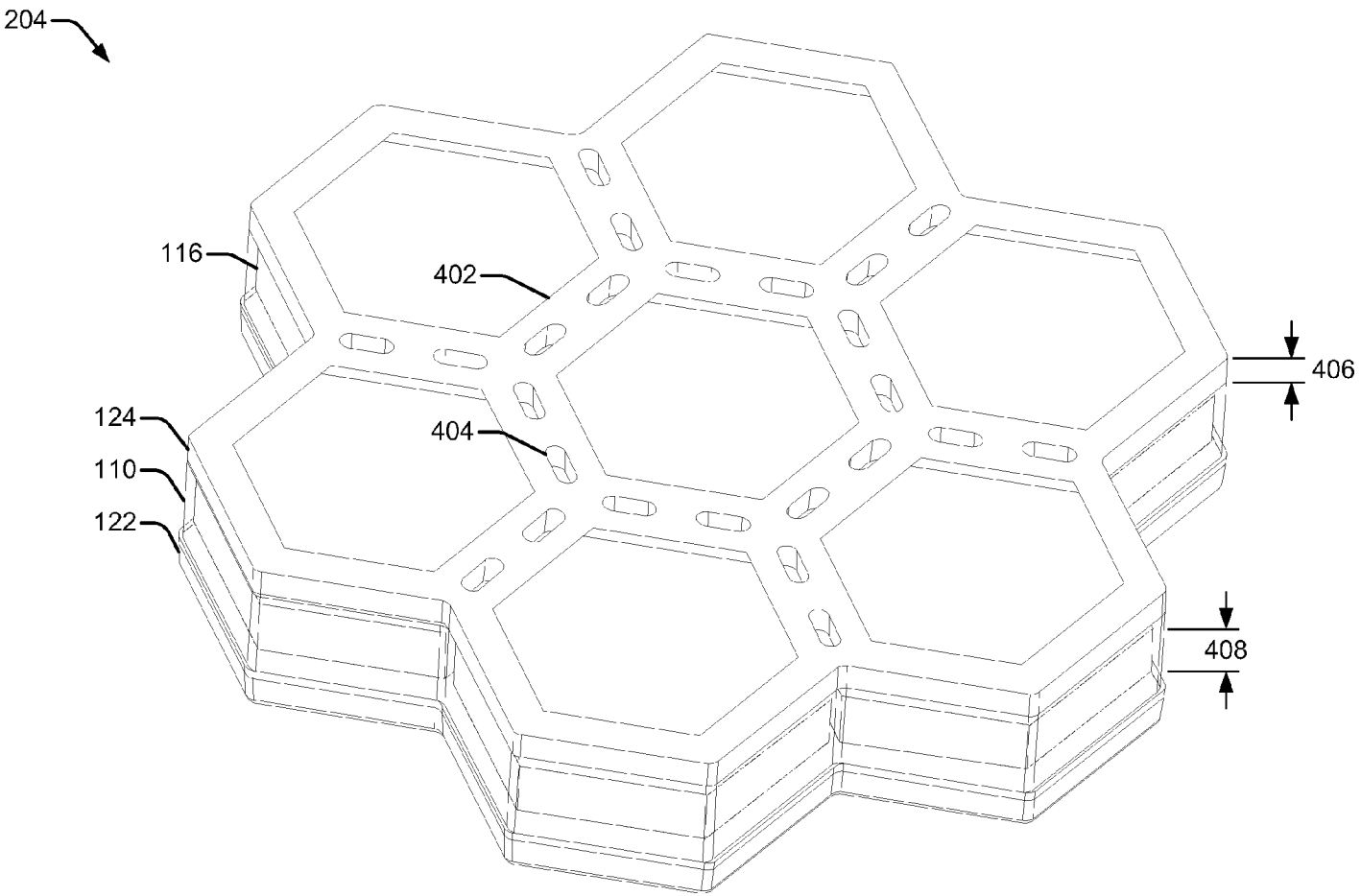
FIG. 4 illustrates a back of the seam protected encapsulated array of solid ceramic elements illustrated in FIG. 2.

FIG. 4 illustrates a back of the seam protected encapsulated array 204 illustrated in FIG. 2. FIG. 4 illustrates that the stiffener 124 may be fixed to the second surface 114 of the encapsulated array 110 and arranged in-line with the vulnerable seams 120 to provide a backing to the seams 120. For example, structural lattice members 402 forming the geometric pattern of stiffener 124 may be arranged around the edges of the ceramic elements 116. The stiffener 124 may include apertures 404 for receiving a metal alloy. For example, a molten alloy (e.g., aluminum) may be squeeze cast, die cast, or the like, into the apertures 404 of the stiffener 124. The molten alloy received by the apertures 404 may then solidify inside voids arranged in the structural lattice members 402 of the stiffener 124, fixing or locking the stiffener 124 to the second surface 114 of the encapsulated array 110. The solidified alloy may be used as an attachment mechanism. For example, the solidified alloy may be used to attach the seam protected encapsulated array 204 to an armor assembly, to a vehicle, or to attach another member to the seam protected encapsulated array 204.

The stiffener 124 may have a thickness 406 of about 1 to 1.5 times a thickness 408 of the array 110. For example the thickness 408 of the array 110 may be about 1.4 inches (3.5 centimeters) thick, which may be substantially the same as a thickness of each ceramic element 116. Thus, the thickness 406 of the stiffener 124 may be about 1.4 inches (3.5 centimeters) to about 2.1 inches (5.3 centimeters) thick.

FIG. 5 illustrates a section view of the seam protected encapsulated array 204 taken along the section line A-A illustrated in FIG. 3. FIG. 5 illustrates that the seam protector 122, the vulnerable seam 120, and/or the stiffener 124 may be arranged in-line. For example, the seam protector 122, the vulnerable seam 120, and the stiffener 124 may be arranged in-line with line 502. Further, each of the peaks 208 may be arranged in-line with the vulnerable seams 120. For example, each peak 208 and respective vulnerable seam 120 may be arranged in-line with a line 502.

Each of the members 206 may include a sloped surface 504 arranged between the peak 208 and the base 210. An angle 506 of the sloped surface 504 may be any angle less than 180 degrees to provide for deflecting a projectile. For example, each of the members 206 may comprise a triangular cross-sectional shape (e.g., equilateral shaped triangle, isosceles shaped triangle, acute shaped triangle, etc.) where the angle 506 of sloped surface 504 provides for deflecting a projectile. For example, the sloped surface 504 may have an angle 506 that receives an indirect or glancing impact from a projectile rather than a direct or square impact. Further, the members 206 may compromise or break-up a projectile upon impact.

While the members 206 are illustrated as having a triangular shaped cross-section, in other embodiments, the members 206 may have a semicircle cross-sectional shape, oval shape, dome shape, etc. For example, the members 206 may have a curved sloped surface 504. For example, the members 206 may have a convex and/or concave sloped surface 504 between the peak 208 and the base 210. While the sloped surface 504 is illustrated as having a uniform or smooth surface, the sloped surface 504 may be non-uniform. For example, the sloped surfaces 504 may have one or more protruding or indenting features, such as ribs, ridges, grooves, channels, fins, quills, pyramids, mesh, nubs, dimples, or the like. The features may protrude or indent perpendicular to the respective sloped surface 504 or at an oblique angle relative to the respective sloped surface 504. The non-uniform surface may provide for enhancing each of the member's 206 ability to compromise or break-up a projectile upon impact.

The section view of the seam protected encapsulated array 204 taken along section line A-A illustrates that a barrier layer 508 may cover (e.g., wrap, coat, enclose, etc.) the solid ceramic elements 116 in the array 106 of solid ceramic elements 116. The barrier layer 508 may have a wall thickness 510 dependent on a thermal expansion coefficient of the metal alloy 108 to be accommodated, and/or on a desired seam size 512 of the encapsulated array 110. For example, the metal alloy 108 may be an iron alloy (e.g., FeMnAl) that encapsulates ceramic elements 116 formed of silicon carbide. The ceramic elements 116 may be wrapped in a barrier layer 508 having a wall thickness 510 of about 0.060 inches (0.15 centimeters), which provides a desired seam size 512 of about 0.17 inches (0.4 centimeters). The wall thickness 510 may be substantially uniform around the solid ceramic element 116.

Further, as illustrated in side view 514, the barrier layer 508 may include a first barrier layer 516 (e.g., a refractory layer) and a second barrier layer 518 (e.g., a compressible layer) to integrate or combine the solid ceramic elements 116 formed of silicon carbide with the metal alloy 108. For example, the first barrier layer 516 may be for preventing the metal alloy 108 from reacting with the solid ceramic elements 116 during a casting process, while the second barrier layer 518 may be for providing crush/compression protection during a cooling process. For example, the first barrier layer 516 may prevent a molten steel alloy from undesirably reacting with the solid ceramic elements formed of silicon carbide, while the second barrier layer 518 may prevent the steel alloy from shrinking down onto the solid ceramic elements 116 and undesirably cracking either or both of the solid ceramic elements and/or the solidified steel alloy.

While the side view 514 illustrates the barrier layer 508 including two barrier layers, (i.e., the first barrier layer 516 and second barrier layer 518), the barrier layer may include any number of layers. For example, the barrier layer 508 may comprise multiple alternating layers of the first barrier layer 516 and the second barrier layer 518.

The first barrier layer 516 may be formed of a metal film having a thickness 520 of at least about 0.001 inches (0.002 centimeters), and up to at most about 0.009 inches (0.02 centimeters). Further, the first barrier layer 516 may be an aluminum foil wrapped around both the second barrier layer 518 and the ceramic elements 116, an electroplated deposit deposited around both the second barrier layer 518 and the ceramic elements 116, a coating (e.g., a powder coating, a liquid coating, etc.) applied around both the second barrier layer 518 and the ceramic elements 116, or the like suitable for preventing a molten steel alloy from undesirably reacting with the solid ceramic elements formed of silicon carbide. For example, the first barrier layer 516 may be formed of an aluminum foil having a thickness 520 of about 0.002 inches (0.005 centimeters), and wrapped around both the second barrier layer 518 and the ceramic elements 116.

The second barrier layer 518 may be formed of an alumina fiber, a porous ceramic, a powder (e.g., a compacted powder, a powdered metallurgy), or the like suitable for preventing a steel alloy from shrinking down onto the solid ceramic elements formed of silicon carbide and undesirably cracking either or both of the solid ceramic elements and/or the solidified steel alloy. For example, the second barrier layer 518 may be formed of an alumina fiber having a thickness 522 of at least about 0.050 inches (0.13 centimeters), and up to at most about 0.060 inches (0.15 centimeters), and wrapped around the ceramic elements 116. The second barrier layer 518 may be disposed between the first barrier layer 516 and each of the ceramic elements 116.

The stiffener 124 may include voids 524 arranged in the structural lattice members 402 of the stiffener 124. For example, the voids 524 may comprise dovetail shaped walls 526 arranged in the structural lattice members 402. The dovetail shaped voids 524 may receive molten alloy via a squeeze cast process, and subsequent to solidification of the molten alloy, the dovetail shaped voids 524 may fix or lock the solidified alloy to the encapsulated solid ceramic tile array 110.

Example Methods of Forming Seam Protected Encapsulated Arrays

Figure 6:
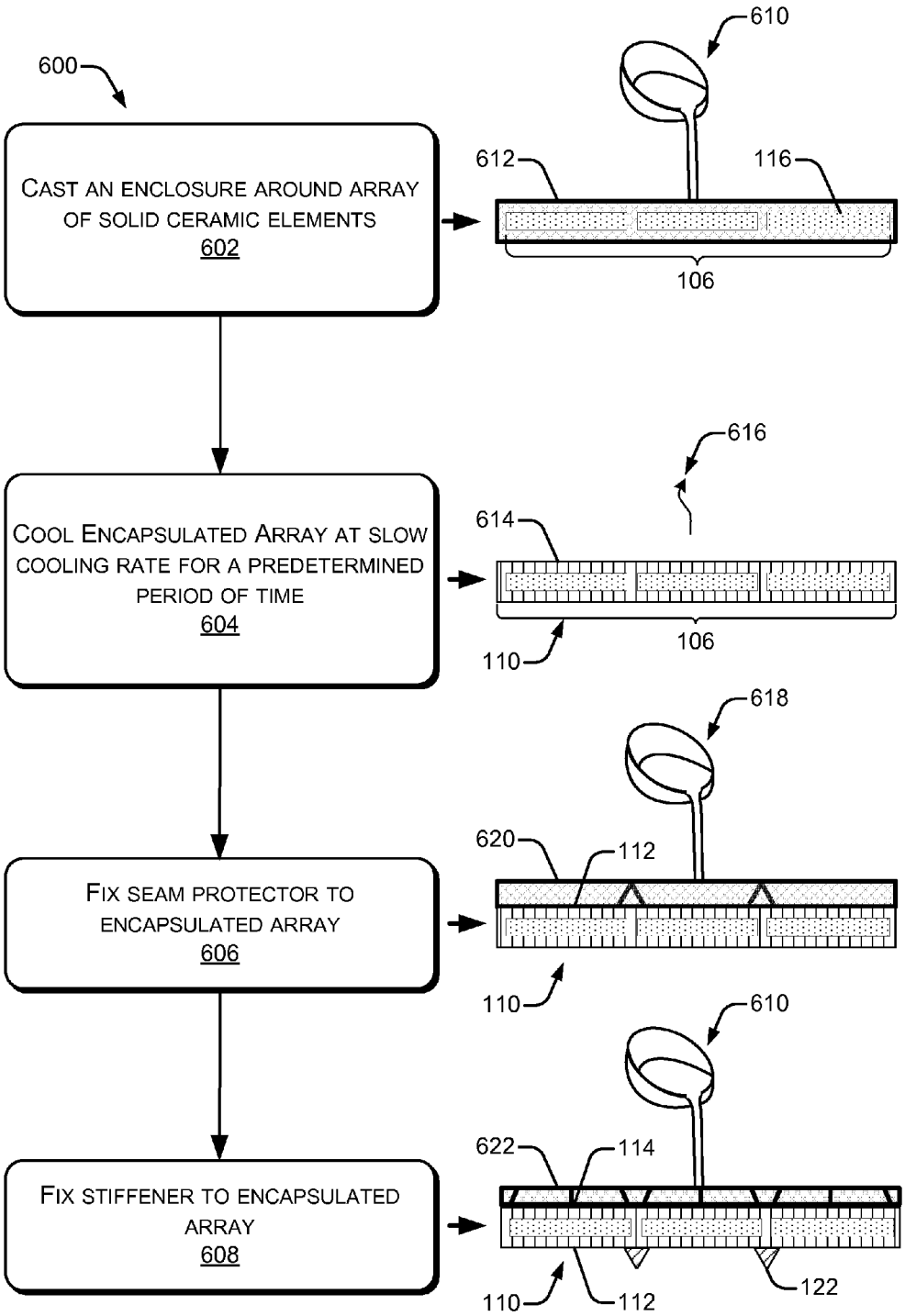
FIGS. 6-8 are flow diagrams illustrating example processes of casting seam protected encapsulated arrays of solid ceramic elements alongside corresponding schematic diagrams illustrating the acts being described in the flow diagrams.

FIG. 6 illustrates an example process 600 of manufacturing a seam protected encapsulated array of solid ceramic elements (e.g., seam protected encapsulated array of solid ceramic elements 204), alongside corresponding schematic diagrams illustrating the operations being described in the process 600. By way of example and not limitation, this process may be performed at a manufacturing facility, a plant, a foundry, a factory, or the like.

Process 600 includes operation 602, which represents casting a metal around an array of solid ceramic elements. For example, a molten base metal 610 may be poured into a casting shell 612 and envelops the array of ceramic elements 106. The base metal 610 may be any type of steel or metal that may be desirable for protection against ballistic impacts. In a specific example, the steel alloy may be steel alloy 4140 or 8630 under the American Iron and Steel Institute (AISI) standard. In other specific examples, the steel alloy may be a stainless steel alloy or FeMnAl.

In some embodiments, one or more of the ceramic elements 116 may be encapsulated with a barrier material. For example, the ceramic elements 116 may be covered (e.g., wrapped, coated, enclosed, etc.) with a barrier layer to integrated with the base metal 610 being poured into the casting shell. As discussed above the barrier layer may prevent the base metal 610 from reacting with the ceramic elements 116 during casting, and/or provide crush/compression protection during cooling.

Process 600 continues with operation 604, which represents cooling the encapsulated array (e.g., encapsulated array 110). For example, a metal layer 614 may solidify around the surface of the ceramic elements 116 as energy or heat 616 dissipates from the encapsulated array 110 at a relatively slow cooling rate for a predetermined period of time in a temperature controlled environment (e.g., a cooling tunnel, furnace, or the like). The casting, including the metal layer 614 and the array of ceramic elements 106 defining an encapsulated array 110. The controlled cooling may be implemented by decreasing the amount of energy being exposed to the encapsulated array 110. Alternatively, the encapsulated array 110 may be allowed to cool in a temperature controlled environment that limits the cooling rate without introducing outside energy or heat. The cooling rate and the predetermined period of time may be at a "slow rate." As used herein, the term "slow rate" means a rate slower than a rate at which the component would air cool if placed in a location at standard temperature and pressure. The specific slow rate of cooling and the specified period of time depend on the specific combination of ceramic material and base metal, size and shape of the ceramic elements, and the desired material properties of the composite material. In some embodiments, the casting shell and encapsulated array 110 may be cooled at a continuous slow rate until it reaches a predetermined temperature (e.g., 50% of the pouring temperature, 20% of the pouring temperature, room temperature, etc.). Examples of continuous slow rates of cooling that may be used in various embodiments include rates at most about 300 degrees F. per hour, at most about 200 degrees F. per hour, at most about 150 degrees F. per hour, or at most about 100 degrees F. per hour.

Operation 604 may be followed by operation 606, which represents fixing a seam protector 122 to a first surface 112 of the encapsulated array 110. For example, another molten base metal 618 different from the base metal 610 may be poured into another casting shell 620 to cast the seam protector 122 onto the first surface of the encapsulated array 110. Here, in this embodiment, the other molten base metal 618 may be any type of steel or metal that is harder than the alloy formed around the array of ceramic elements 106. For example, the molten base metal 618 may be a high-chrome iron (or white iron) that when solidified onto the encapsulated array 110 is harder than the encapsulating metal (e.g., a steel alloy, such as FeMnAl, stainless steel, 4140 AISI steel, 8630 AISI steel, etc.) around the array of ceramic elements 106.

Process 600 may be completed at operation 608, which represents fixing a stiffener 124 to a second surface 114 opposite to the first surface 112. For example, the molten base metal 610 may be poured into another casting shell 622 to cast the stiffener 124 onto the second surface 114 of the encapsulated array 110. Here, in this embodiment, the other casting shell 622 may be a separate unit for casting the stiffener 124 onto the encapsulated array 110, or the casting shell 622 may be formed integral with the casting shell 612. In the embodiment where the casing shell 622 is a separate unit, the stiffener 124 may be cast onto the encapsulated array 110 subsequent to the cooling operation 604. In the embodiment where the casting shell 622 is formed integral with the casting shell 612, the stiffener 124 may be cast with the encapsulated array 110 during the casting operation 602. In this embodiment, the stiffener 124 and the encapsulated array 110 may be formed as a single unit.

Figure 7:
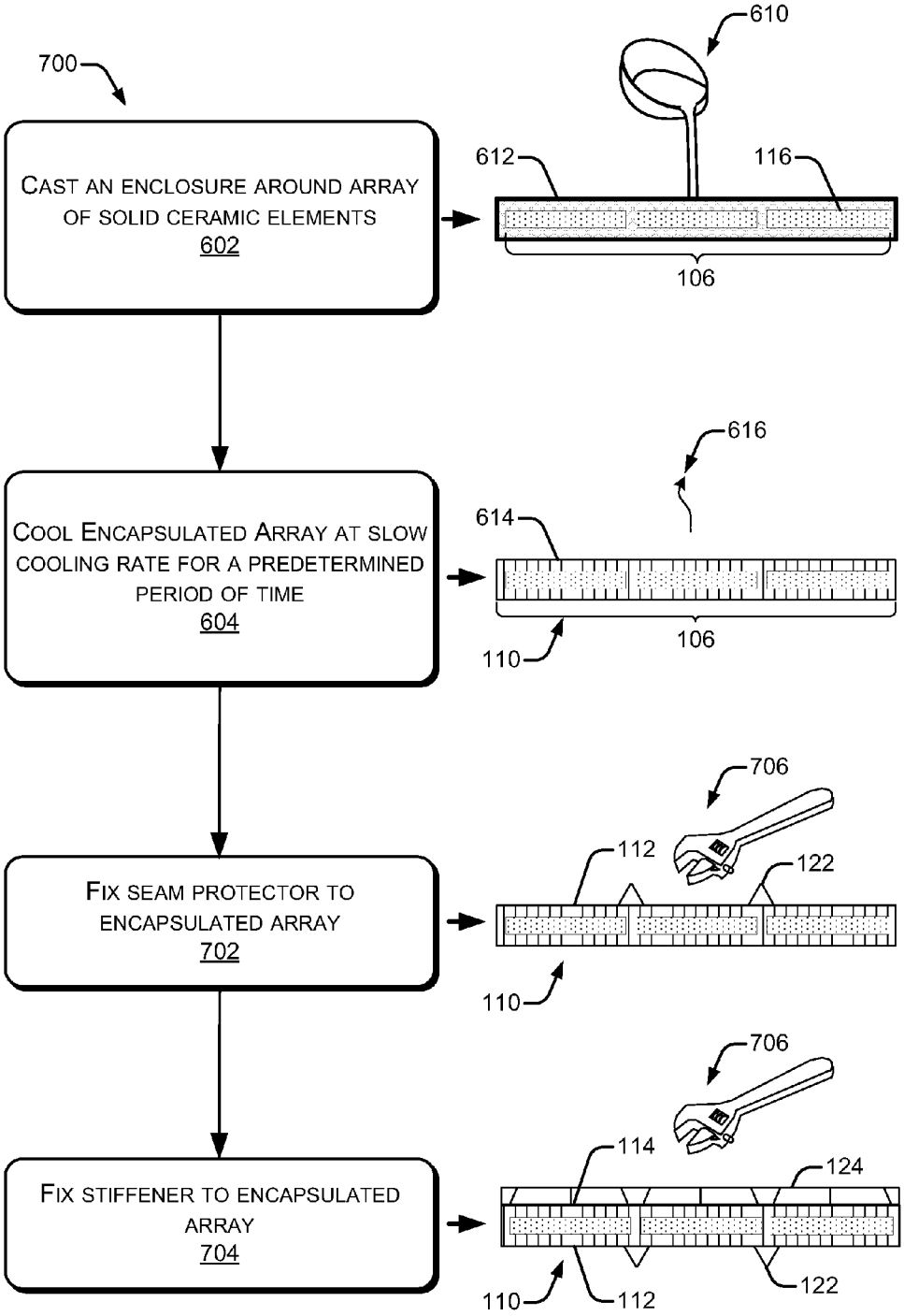

FIG. 7 illustrates another example process 700 of manufacturing the seam protected encapsulated array 204, alongside corresponding schematic diagrams illustrating the operations being described in the process 800. Similar to process 600, process 700, by way of example and not limitation, may be performed at a manufacturing facility, a plant, a foundry, a factory, or the like. Further, one or more operations of process 700 may be performed in the field or at a second manufacturing facility (e.g., an assembly plant).

Process 700 includes operations 602 and 604, which as discussed above with regard to FIG. 6, represent casting an enclosure around an array of ceramic elements 106, and cooling the encapsulated array 110, respectively. Process 700 may include operation 702, which represents fixing a seam protector 122 to a first surface 112 of the encapsulated array 110, via a mechanical fastener. For example, a device 706 (e.g., a piece of equipment, an instrument, an apparatus, etc.) may be used along with a mechanical fastener (e.g., threaded fastener(s), pin(s), rivet(s), batten(s), or the like) to fix the seam protector 122 to the encapsulated array 110. In addition to the mechanical fastener or as an alternative to the mechanical fastener, an adhesive may be used to fix the seam protector 122 to the encapsulated array 110. Further, the seam protector 122 may be welded and/or braised to the encapsulated array 110.

In the embodiment, where the seam protector 122 is fixed to the encapsulated array 110 via a fastener, the seam protector 122 may be pre-cast or pre-machined from the other base metal 618, that when solidified is harder than the encapsulating metal. Further, the seam protector 122 may be pre-fabricated of a ceramic and subsequently fixed to the encapsulated array 110 via a mechanical fastener.

Process 700 may be completed at operation 704, which represents fixing a stiffener 124 to a second surface 114 opposite to the first surface 112, via a mechanical fastener. For example, the device 706 may be used along with a mechanical fastener to fix a stiffener 124 to the encapsulated array 110. In addition to the mechanical fastener or as an alternative to the mechanical fastener, an adhesive may be used to fix the stiffener 124 to the encapsulated array 110.

In the embodiment, where the stiffener 124 is fixed to the encapsulated array 110 via a fastener, the stiffener 124 may be pre-cast or pre-machined from the base metal 610 used to cast the enclosure in operation 602.

Figure 8:
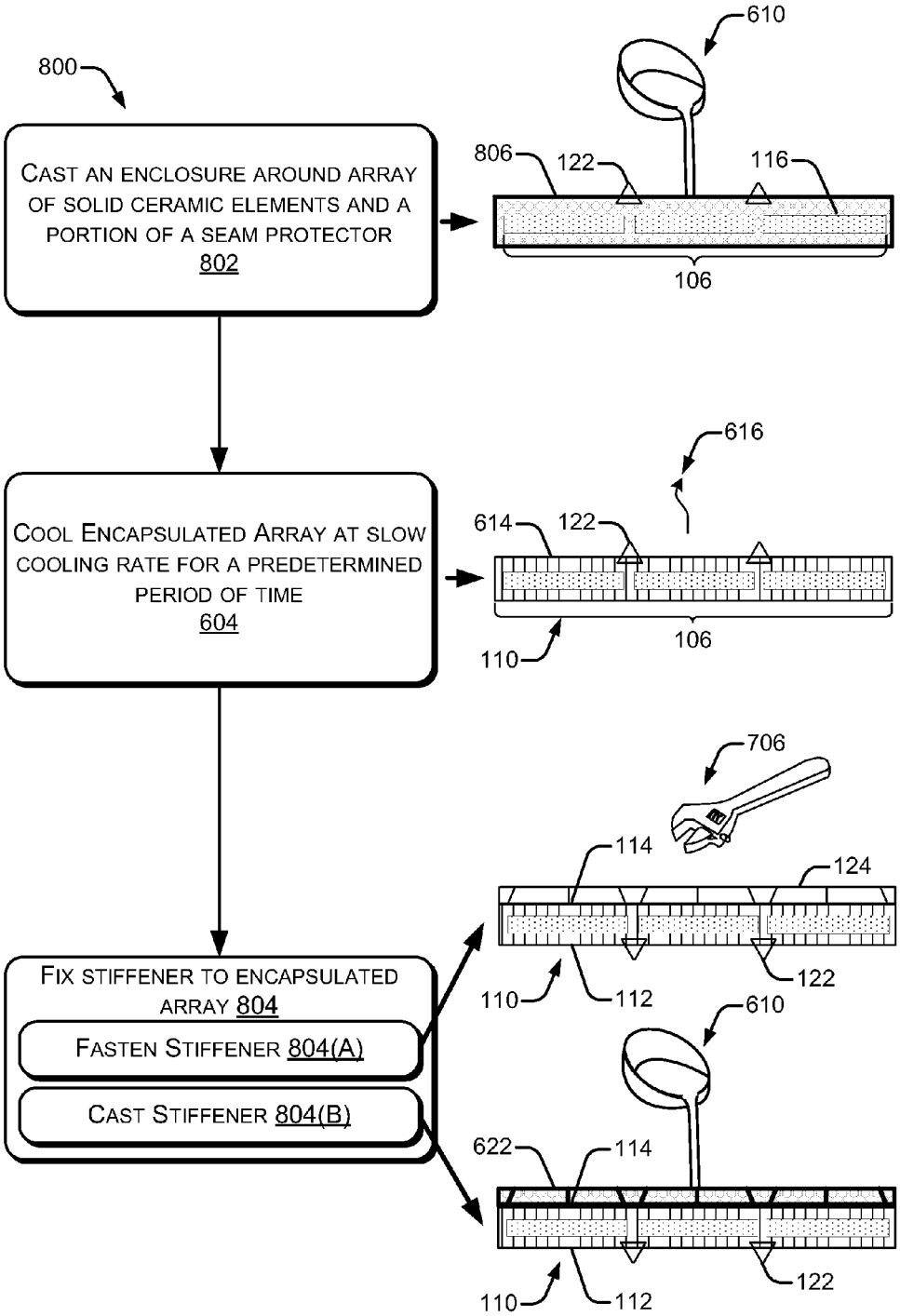

FIG. 8 illustrates another example process 800 of manufacturing the seam protected encapsulated array 204, alongside corresponding schematic diagrams illustrating the operations being described in the process 800. By way of example and not limitation, this process may be performed at a manufacturing facility, a plant, a foundry, a factory, or the like.

Process 800 includes operation 802, which represents casting an enclosure, formed of an alloy, around an array of ceramic elements 106 and at least a portion of a seam protector 122. For example, a molten base metal 610 may be poured into a casting shell 806 and envelops the array of ceramic elements 106, and envelops at least a portion of the seam protector 122. While process 800 describes the base metal 610 enveloping a portion of the seam protector 122, the base metal 610 may envelop substantially the entire seam protector 122. For example, the base metal 610 may encapsulate both the seam protector 122 as well as the array of ceramic elements 106.

In the embodiment, where the seam protector 122 is cast in situ or otherwise partially encapsulated or entirely encapsulated in the base metal 610 cast around the array of ceramic elements 106, the seam protector 122 may be pre-cast or pre-machined from the other base metal 618, that, when solidified, is harder than the encapsulating metal. Further, the seam protector 122 may be pre-fabricated of a ceramic.

Process 800 may include operation 604, which again represents cooling the encapsulated array 110.

Process 800 may be completed at operation 804, which represents fixing a stiffener 124 to a second surface 114 opposite to the first surface 112. Operation 804 may comprise operation 804(A), which represents fixing the stiffener 124 to the second surface 114 opposite to the first surface 112, via a mechanical fastener. Further, the stiffener 124 may be welded and/or braised to the encapsulated array 110.

Alternatively, operation 804 may comprise operation 804(B), which represents casting the stiffener 124 onto the second surface 114 of the encapsulated array 110. For example, the molten base metal 610 may be poured into the other casting shell 622 to cast the stiffener 124 onto the second surface 114 of the encapsulated array 110. The other casting shell 622 may be a separate unit for casting the stiffener 124 onto the encapsulated array 110, or the casting shell 622 may be formed integral with the casting shell 806 for casting the stiffener 124 and the encapsulated array 110 as a single unit.

Example Encapsulating Materials

This section describes an exemplary encapsulated array of solid ceramic elements comprising an additive in an encapsulating metal (i.e., base metal) of the encapsulated array of solid ceramic elements.

In some examples, the encapsulating metal may be FeMnAl, high chrome iron, both FeMnAl and high chrome iron, or the like. In some implementations, the additive may be a ceramic grit formed of a metal matrix composite (MMC) (e.g., FeMnAl/alumina), a ceramic, a mixture of ceramic and metal, or the like. In some implementations, the additive may be added to the encapsulating base metal such that the additive is disposed in a portion (e.g., a first portion) of the encapsulating base metal and about the ceramic elements. In some implementations, seam protectors may be arranged above seams of the ceramic elements, and the additive may be added to the encapsulating base metal such that the additive is disposed in the portion of the encapsulating base metal below the ceramic elements. In some embodiments, the additive may be added to an encapsulating base metal such that the additive is disposed in multiple portions (e.g., first and second portions) of the encapsulating base metal. In some embodiments, the additive may be added to an encapsulating base metal formed around seam protectors. These and numerous other encapsulated arrays of solid ceramic elements comprising an additive in an encapsulating metal layer can be formed according to the techniques described in this section.

Figure 9:
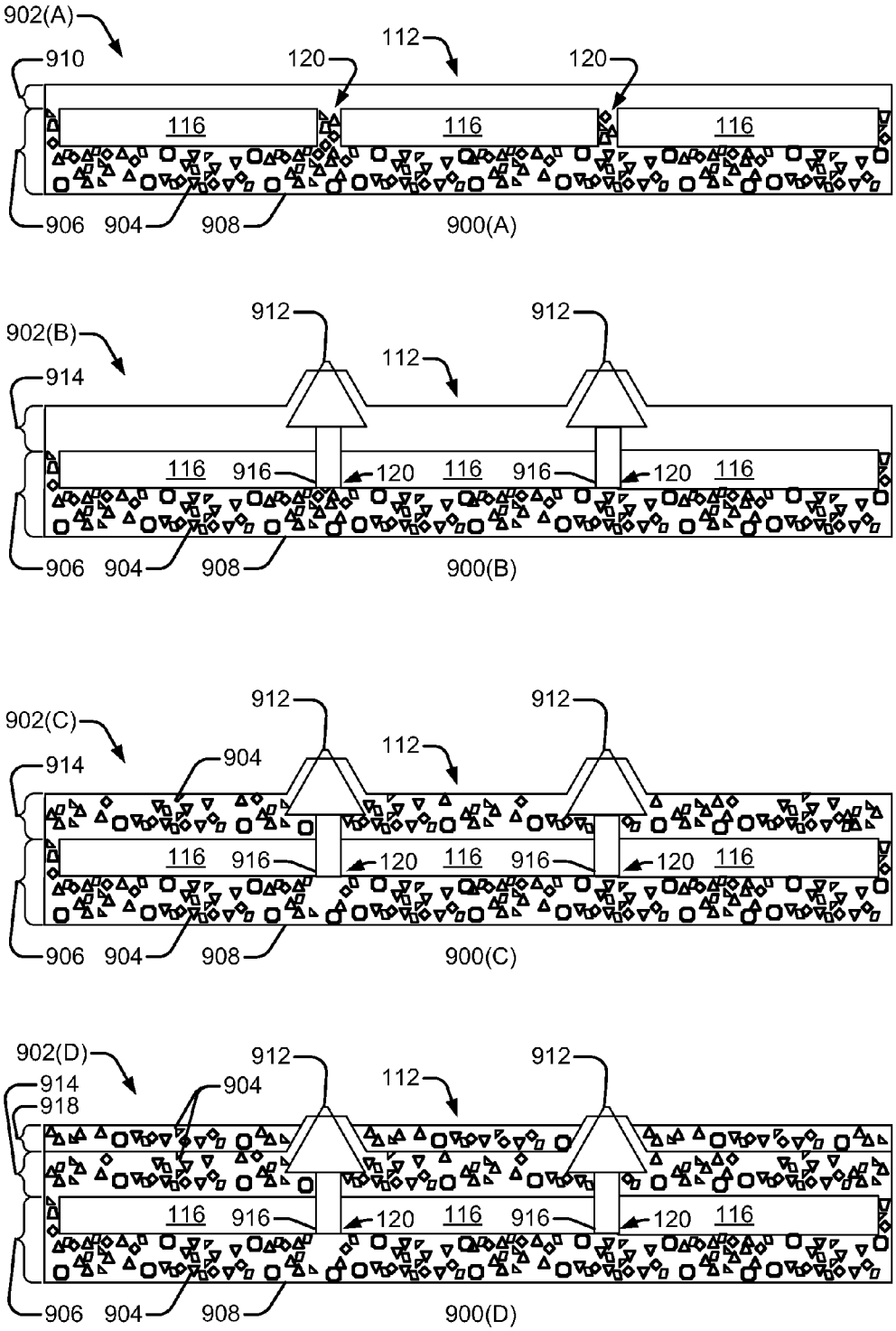
FIG. 9 illustrates section views of example encapsulated arrays of solid ceramic elements. The section views of encapsulated arrays of solid ceramic elements illustrate an additive in portions of an encapsulating metal of each of the encapsulated arrays of solid ceramic elements.

FIG. 9 illustrates section views 900(A), 900(B), 900(C), and 900(D) of encapsulated arrays of solid ceramic elements 902(A), 902(B), 902(C), and 902(D). The section views 900(A)-(D) of the encapsulated arrays of solid ceramic elements 902(A)-(D) illustrate an additive 904 in portions of an encapsulating metal of each of the encapsulated arrays of solid ceramic elements 902(A)-(D).

Section view 900(A) illustrates that the encapsulated array of solid ceramic elements 902(A) may include the additive 904 in a first portion 906 (e.g., a bottom or backing portion) of an encapsulating metal 908 of the encapsulated array of solid ceramic element 902(A). The additive 904 may be dispersed throughout the first portion 906, while a second portion 910 (e.g., a top portion), opposite the first portion 906, may be substantially free, or void, of the additive 904. For example, the additive 904 may be dispersed evenly (e.g., with about a same density) in the first portion 906 generally below second portion 910 and about the solid ceramic elements 116 in the array 106 of solid ceramic elements 116.

Section view 900(A) illustrates an embodiment in which the encapsulated array of solid ceramic elements 900(A) does not include a seam protector (e.g., seam protector 122). In this example, the additive 904 may be dispersed in the encapsulating metal 908 between the solid ceramic elements 116 at the seams 120. Because the seams 120 include the encapsulating metal 908 having the additive 904, the seams 120 with the additive are harder than encapsulating metal 908 without the additive 904. For example, when a projectile first encounters the seams 120 including the additive 904 below the first surface 112, the projectile may be broken up or otherwise compromised, providing protection against projectiles.

Section view 900(B) illustrates an embodiment of the encapsulated array of solid ceramic elements 902(B) which includes a seam protector 912. Similar to the seam protector 122 discussed above, the seam protector 912 may be formed of a hard material (e.g., a white iron, high chrome iron, or a ceramic). Section view 900(B) illustrates the seam protector 912 may be aligned with, and disposed over, the seams 120. The encapsulated array of solid ceramic elements 902(B) may include a second portion 914 of the encapsulating metal 908 that at least partially encapsulates the seam protector 912. While section view 900(B) illustrates the second portion 914 of the encapsulating metal 908 partially encapsulating the seam protector 912, the second portion 914 of the encapsulating metal 908 may encapsulate substantially all of the seam protector 912. For example, the encapsulating metal 908 may encapsulate the seam protector 912 such that no portion of the seam protector 912 is exposed on the first surface 112.

Section view 900(B) illustrates an embodiment of the encapsulated array of solid ceramic elements 902(B) which includes a member 916 extending distally from the seam protector 912. For example, the member 916 may extend away from the seam protector 912 down into, and be disposed in, the seams 120. The member 916 may be formed of a hard material (e.g., a white iron, high chrome iron, or a ceramic), similar to the seam protector 912. For example, the seam protector 912 and the member 916 may be formed as a single unitary unit of the hard material.

Section view 900(C) illustrates the encapsulated array of solid ceramic elements 902(C) including the additive 904 in the second portion 914 of the encapsulating metal 908. For example, the additive 904 may be dispersed throughout the first portion 906 and the second portion 914 of the encapsulating metal 908. Because the additive 904 may be dispersed in the encapsulating metal 908 of the second portion 914, the first surface 112 is harder than without the additive 904, adding protection against projectiles.

Section view 900(D) illustrates an embodiment in which the encapsulated array of solid ceramic elements 902(D) includes the additive 904 in a third portion 918 of the encapsulating metal 908. For example, the additive may be dispersed throughout the third portion 918 of the encapsulating metal 908 layered on top of the second portion 914. Because the additive 904 may be dispersed in the encapsulating metal 908 of the third portion 918 layered on top of the second portion 914 of the encapsulating metal 908 including the additive 904, the first surface 112 is harder than a single layer (e.g., second potion 914) of the encapsulating metal 908 having the additive 904, adding greater protection against projectiles.

Figure 10:
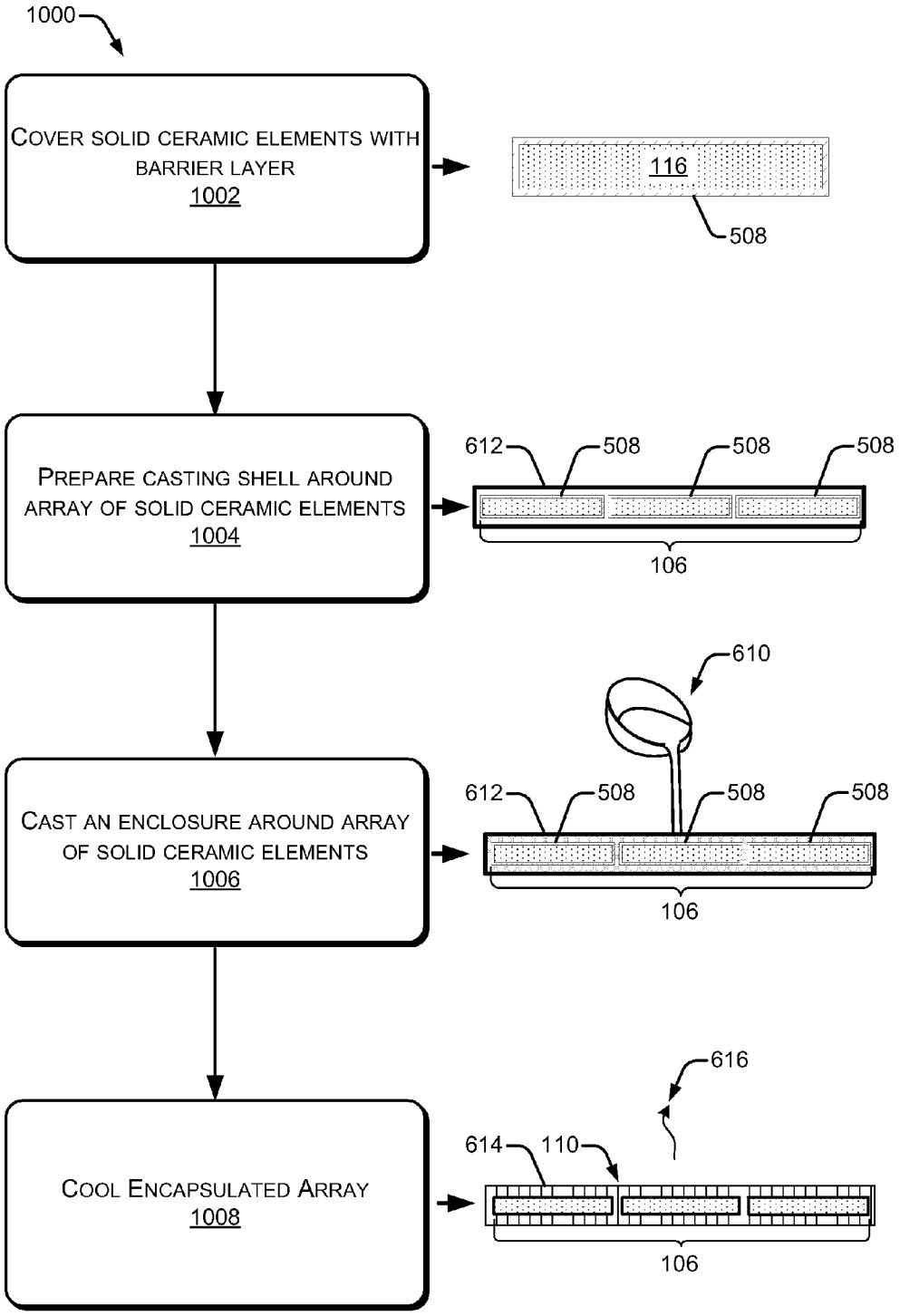
FIG. 10 is a flow diagram illustrating an example process of manufacturing an encapsulated array with ceramic elements covered with a barrier layer alongside corresponding schematic diagrams illustrating the acts being described in the flow diagram.

Example Method of Forming an Encapsulated Array with Barrier Layer Covered Tiles FIG. 10 illustrates an example process 1000 of manufacturing an encapsulated array (e.g., encapsulated array 110) with ceramic elements (e.g., ceramic elements 116) covered with a barrier layer (e.g., barrier layer 508), alongside corresponding schematic diagrams illustrating the operations being described in the process 1000. By way of example and not limitation, this process may be performed at a manufacturing facility, a plant, a foundry, a factory, or the like.

Process 1000 includes operation 1002, which represents covering or encapsulating (e.g., wrapping, coating, enclosing, etc.) each solid ceramic element in an array of solid ceramic elements (e.g., array of ceramic elements 106) with the barrier layer. For example, a foundry casting the array of solid ceramic elements may manually cover each ceramic element, or the foundry casting the array of solid ceramic elements may be provided with the ceramic elements already covered with the barrier layer. For example an outside manufacturing facility may cover the solid ceramic elements and provide the covered solid ceramic elements to the foundry casting the array of solid ceramic elements.

Process 1000 includes operation 1004, which represents preparing a casting shell 612 around the array of solid ceramic elements covered with the barrier layer. For example, the array of solid ceramic elements may be encapsulated in a pattern material, which is then coated or encapsulated in a casting shell. Subsequently, the casting shell may be heated to remove the pattern material creating an air gap for receiving a molten metal alloy.

Process 1000 includes operation 1006, which represents casting a metal around the array of solid ceramic elements with the barrier layer covering each solid ceramic element. For example, a molten base metal 610 may be poured into the casting shell 612 and envelops the array of solid ceramic elements. As discussed above, the base metal 610 may be any type of steel or metal that may be desirable for increased strength and toughness to keep the tiles in compression. In a specific example, the steel alloy may be FeMnAl. In the example where the steel alloy is FeMnAl, and as discussed above, the barrier layer covering each solid ceramic element prevents the base metal alloy 610 from reacting with the solid ceramic elements.

Process 1000 includes operation 1008, which represents cooling the encapsulated array. For example, a metal layer 614 may solidify around the surface of the solid ceramic elements covered with the barrier layer as energy or heat 616 dissipates from the encapsulated array at a relatively slow cooling rate for a predetermined period of time in a temperature controlled environment (e.g., a cooling tunnel, furnace, or the like). The casting, including the metal layer 614 and the array of solid ceramic elements with the barrier layer covering each solid ceramic element defining an encapsulated array 110. Here, and as discussed above, the barrier layer covering each solid ceramic element provides crush/compression protection during the cooling of the encapsulated array.

CONCLUSION

Although the disclosure uses language specific to structural features and/or methodological acts, the claims are not limited to the specific features or acts described. Rather, the specific features and acts are disclosed as illustrative forms of implementing the invention. For example, the various embodiments described herein may be rearranged, modified, and/or combined. As another example, one or more of the method acts may be performed in different orders, combined, and/or omitted entirely, depending on the composite component to be produced.

What is claimed is:

1. A method comprising:

encapsulating a solid ceramic tile in a barrier layer comprising a compressible layer comprising alumina fiber encapsulating the solid ceramic tile and a refractory layer comprising a metal film encapsulating the alumina fiber encapsulating the solid ceramic tile; and casting a steel alloy around the barrier layer and the solid ceramic tile, the steel alloy applying a compression force and the alumina fiber damping the compression force applied by the steel alloy to provide crush protection between the steel alloy and the solid ceramic tile, and the refractory layer preventing the steel alloy from reacting with the solid ceramic tile.

2. The method of claim 1, further comprising:

cooling the steel alloy and the solid ceramic tile.

3. The method of claim 2, wherein the compressible layer provides crush protection between the steel alloy and the solid ceramic tile during the cooling of the steel alloy and the solid ceramic tile.

4. The method of claim 1, wherein the refractory layer prevents the steel alloy from reacting with the solid ceramic tile during the casting of the steel alloy around the solid ceramic tile.

5. The method of claim 1, wherein the metal film comprises an electroplated deposit, and the electroplated deposit encapsulates the compressible layer and the solid ceramic tile.

6. The method of claim 1, wherein the metal film comprises a powder coat, and the powder coat encapsulates the compressible layer and the solid ceramic tile.

7. The method of claim 1, wherein the metal film comprises a paint coating, and the paint coating encapsulates the compressible layer and the solid ceramic tile.

8. The method of claim 1, wherein the solid ceramic tile comprises silicon carbide.

9. A method comprising:

providing an array of solid ceramic tiles comprising:

a first layer, encapsulating each solid ceramic tile of the array of solid ceramic tiles, to prevent a steel alloy from reacting with the array of solid ceramic tiles during the casting of the steel alloy around the array of solid ceramic tiles; and a second layer, disposed between the first layer and each solid ceramic tile, the second layer to dampen a compression force applied by the steel alloy to provide crush protection between the steel alloy and each solid ceramic tile during a cooling of the composite array; and casting the steel alloy around the array of solid ceramic tiles.

10. The method of claim 9, wherein each solid ceramic tile comprises silicon carbide.

11. The method of claim 9, wherein the first layer comprises a metal film and the second layer comprises an alumina fiber.

12. A method comprising:

individually encapsulating a single element formed of silicon carbide in a barrier layer, including individually encapsulating the silicon carbide element in a compressible layer; and casting a metal around the barrier layer and the silicon carbide element, wherein the barrier layer prevents interaction of the metal and the silicon carbide element during a casting of the metal around the silicon carbide element, and during a cooling of the metal, and wherein the compressible layer provides crush protection between the metal and the silicon carbide element during the cooling of the metal.

13. The method of claim 12, wherein individually encapsulating the silicon carbide element comprises:

individually encapsulating the silicon carbide element in a refractory layer to prevent the metal from reacting with the silicon carbide element during the casting of the metal around the silicon carbide element.

14. The method of claim 13, wherein the refractory layer comprises a metal film individually encapsulating the compressible layer and the silicon carbide element.

15. The method of claim 14, wherein the metal film has a thickness of at least about 0.001 inches (0.002 centimeters), and at most about 0.009 inches (0.02 centimeters).

16. The method of claim 13, wherein the compressible layer comprises an alumina fiber disposed between the refractory layer and the silicon carbide element.

17. The method of claim 13, wherein the compressible layer has a thickness of at least about 0.05 inches (0.13 centimeters), and at most about 0.06 inches (0.15 centimeters).

18. A method comprising:

encapsulating a solid ceramic element in a barrier layer; and casting a metal around the barrier layer and the solid ceramic element, wherein the barrier layer comprises:

a compressible layer to provide crush protection between the metal and the solid ceramic element after the casting of the metal and during a cooling of the metal; and a refractory layer to prevent the metal from reacting with the solid ceramic element.

19. The method of claim 18, wherein the refractory layer comprises a metal film individually encapsulating the compressible layer and the solid ceramic element.

20. The method of claim 18, wherein the compressible layer comprises an alumina fiber disposed between the refractory layer and the solid ceramic element.

* * * * *